US005918394A

United States Patent [19]

Babcock

[11] Patent Number: 5,918,394

[45] Date of Patent: Jul. 6, 1999

[54] PICTURE FRAME SUITABLE FOR BINDING WITH PRINTED MATTER

[75] Inventor: John C. Babcock, Waupaca, Wis.

[73] Assignee: Remember When, Inc., Waupaca, Wis.

[21] Appl. No.: 08/876,946

[22] Filed: Jun. 16, 1997

[51] Int. Cl.[6] ..... G09D 3/04

[52] U.S. Cl. ..... 40/122; 40/124.06; 40/124.19; 40/773; 40/774

[58] Field of Search ..... 40/119, 121, 122, 40/773, 774, 777, 124.06, 594, 772, 124.19

[56] References Cited

U.S. PATENT DOCUMENTS

| | | | |
|---|---|---|---|
| 2,177,150 | 10/1939 | Perera et al. | 40/772 |
| 2,524,306 | 10/1950 | Buzzerd | 40/772 |
| 2,587,109 | 2/1952 | Carroll | 40/774 |
| 4,741,119 | 5/1988 | Baryla | 40/594 |
| 5,337,949 | 8/1994 | Seeley | 40/774 |
| 5,426,876 | 6/1995 | Jagoe et al. | 40/122 |

*Primary Examiner*—Cassandra H. Davis
*Attorney, Agent, or Firm*—DeWitt Ross & Stevens S.C.

[57] ABSTRACT

A paperboard picture frame is described which is particularly suitable for binding with calendar pages to provide personalized photocalendars. The picture frame includes a backing panel including slits formed therein, a frame panel with a window defined therein, and a base panel, all of which are preferably made of paperboard, e.g., cardstock. The frame panel is attached to the backing panel at a first folding edge, and the base panel is attached to the frame panel at a second folding edge. The slits in the backing panel may accommodate the edges of a photograph so that the photograph is held against the backing panel. A generally transparent cover sheet is then provided which may have its edges inserted within the slits of the backing panel so that the cover sheet rests above the photograph for protective purposes. The frame panel is folded over the backing panel at the first folding edge, and the base panel is then folded over the backing panel at the second folding edge so that the photograph on the backing panel is displayed through the window in the frame panel.

19 Claims, 4 Drawing Sheets

PICTURE FRAME SUITABLE FOR BINDING WITH PRINTED MATTER

FIELD OR THE INVENTION

This disclosure concerns an invention relating generally to a paperboard picture frame suitable for binding with printed matter, and more specifically to a paperboard picture frame which is suitable for binding in combination with the pages of calendars, books, and the like.

BACKGROUND OF THE INVENTION

The paperboard picture frame with which this disclosure is concerned was developed when trying to develop an improved personalized photocalendar, that is, a calendar of commercial quality which displays photographs selected by its owner. Personalized photocalendars are currently popular items of sale at photo processing shops, as well as drug stores, grocery stores, and other businesses which offer photo processing services. Producers of these photocalendars take photographic prints or negatives selected by a purchaser, digitize them, and then print them adjacent calendar pages and collate them. The collected matter is then bound to form a completed personalized photocalendar.

This process is subject to several disadvantages. First, the digitized and printed photos can suffer from image degradation due to digital scanning, enlargement, and printing processes, particularly if the photos are small or have degraded quality to start with. The digitized and printed pictures quite simply do not have the same appearance as photographs; the digitizing process lends the photos an unnatural-looking "grainy" quality, and the photos often suffer from minor changes in color and contrast. A particular problem with these photocalendars is that the digitized photos, being printed directly adjacent the calendar pages, cannot be removed from the calendars. Thus, if the owner wants to replace photos, e.g., because one or more photos are found to be aesthetically unpleasant, this can only be done by removal of entire pages.

A prior alternate method of producing personalized photocalendars was to take preexisting photographs and laminate them onto cardstock or other heavy material adjacent calendar pages. This process, which was largely used before the advent of the aforementioned digitizing technology and which is not known to be in current use, suffers from many of the same disadvantages of the digitizing process. First, the photos —which are sometimes expensive and irreplaceable—are permanently affixed to the calendar and cannot be altered or removed. Second, owing to occasional problems with the laminating process (e.g., bubbles in the laminating sheets, insufficient heating, or other problems), photos/calendar pages sometimes gain a defective appearance and are unsuitable for inclusion in the calendar. Third, this process required a relatively high expenditure of materials and time to integrate the photos into the calendar.

SUMMARY OF THE INVENTION

The invention, which is defined by the claims set out at the end of this disclosure, is directed to a picture frame suitable for binding with printed materials, particularly calendar pages. The picture frame includes a backing panel including slits formed therein, a frame panel with a window defined therein, and a base panel, all of which are preferably made of paperboard, e.g., cardstock. The frame panel is attached to the backing panel at a first folding edge, and the base panel is attached to the frame panel at a second folding edge.

The slits in the backing panel may accommodate the edges of a photograph so that the photograph is held against the backing panel. A generally transparent cover sheet is then provided which may have its edges inserted within the slits of the backing panel so that the cover sheet rests above the photograph for protective purposes. The frame panel is folded over the backing panel at the first folding edge, and the base panel is then folded over the backing panel at the second folding edge so that the photograph on the backing panel is displayed through the window in the frame panel. Means for adhering the backing panel and frame panel together, e.g., adhesive strips, may be incorporated so that the photograph is more firmly maintained between the backing panel and frame panel. Preferably, the slits of the backing panel (and the insertion of the edges of the photograph therein) are obscured from view by situating the slits outside of the borders of the frame panel's window when the frame panel is folded over the backing panel. Multiple sets of slits may be included in the backing panel for accommodating multiple photographs (and cover sheets, if so desired), and the frame panel may similarly include multiple windows for displaying the photographs. Alternatively, the cover sheet may bear opaque areas which bound transparent areas through which the photographs may be viewed. The opaque areas (or other regions of the cover sheet) may be raised or embossed to enhance the display of the photograph (s).

The picture frame is then bound within a calendar by collating it with calendar pages and binding it thereto, preferably at the backing panel. The calendar pages may include additional picture frames, and the calendar pages may additionally include a pocket section having two pocket panels separated by a fold line, wherein one pocket panel includes a slot cut therein so that when the pocket panels are folded into abutment about the fold line, a pocket is defined which is accessible from the slot. The pocket allows storage of additional photographs, or other matter such as address or date books.

The invention thus provides an attractive, inexpensive, and easily constructed flat picture frame which is suitable for binding with calendar pages or other printed matter, and which allows the easy and rapid replacement of a photograph with one or more alternate photographs. Calendars produced in accordance with the invention are comparable in expense with the prior art calendars noted above, but provide far greater versatility. Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
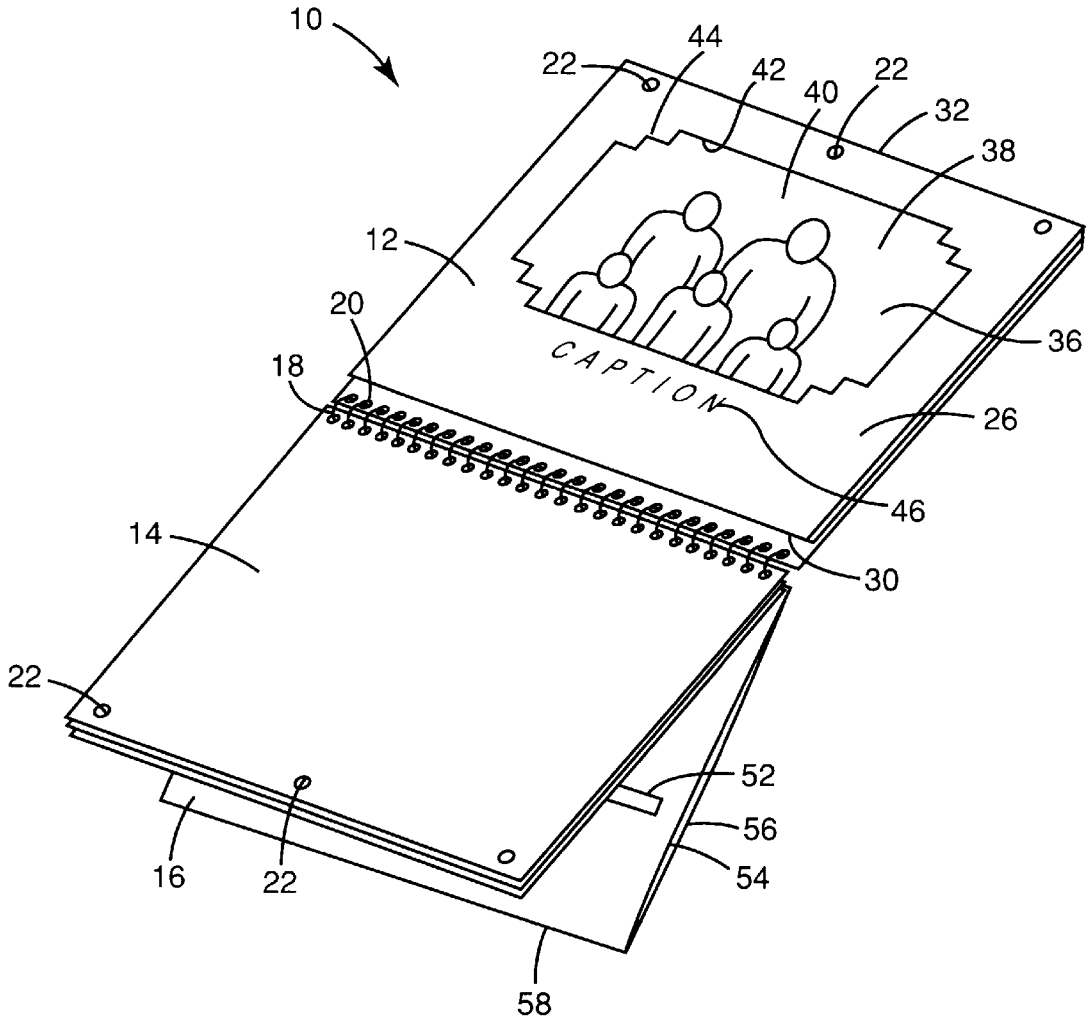
FIG. 1 is a perspective view of a first preferred embodiment of the invention.

In the drawings, wherein the same or similar features of the invention are designated in all Figures with the same reference numerals, a particularly preferred embodiment of the invention is depicted in FIG. 1 as the calendar 10. The calendar 10 includes a picture section 12, calendar pages 14, and a pocket section 16. These are all foldably joined together by use of binding means such as a coil 18 inserted within binding holes 20 in the picture section 12, calendar pages 14, and pocket section 16.

Hanging holes 22 are provided so that the calendar 10 may be hung with different pages 14 displayed. Each of the picture section 12, pages 14, and pocket section 16 are preferably primarily made of paperboard (i.e., paper or cardboard material) which can be reinforced with plastic coatings, laminates, or the like if such is desired. Further details of the construction of each of the picture section 12, pages 14, and pocket section 16 will now be discussed in turn.

Figure 2:
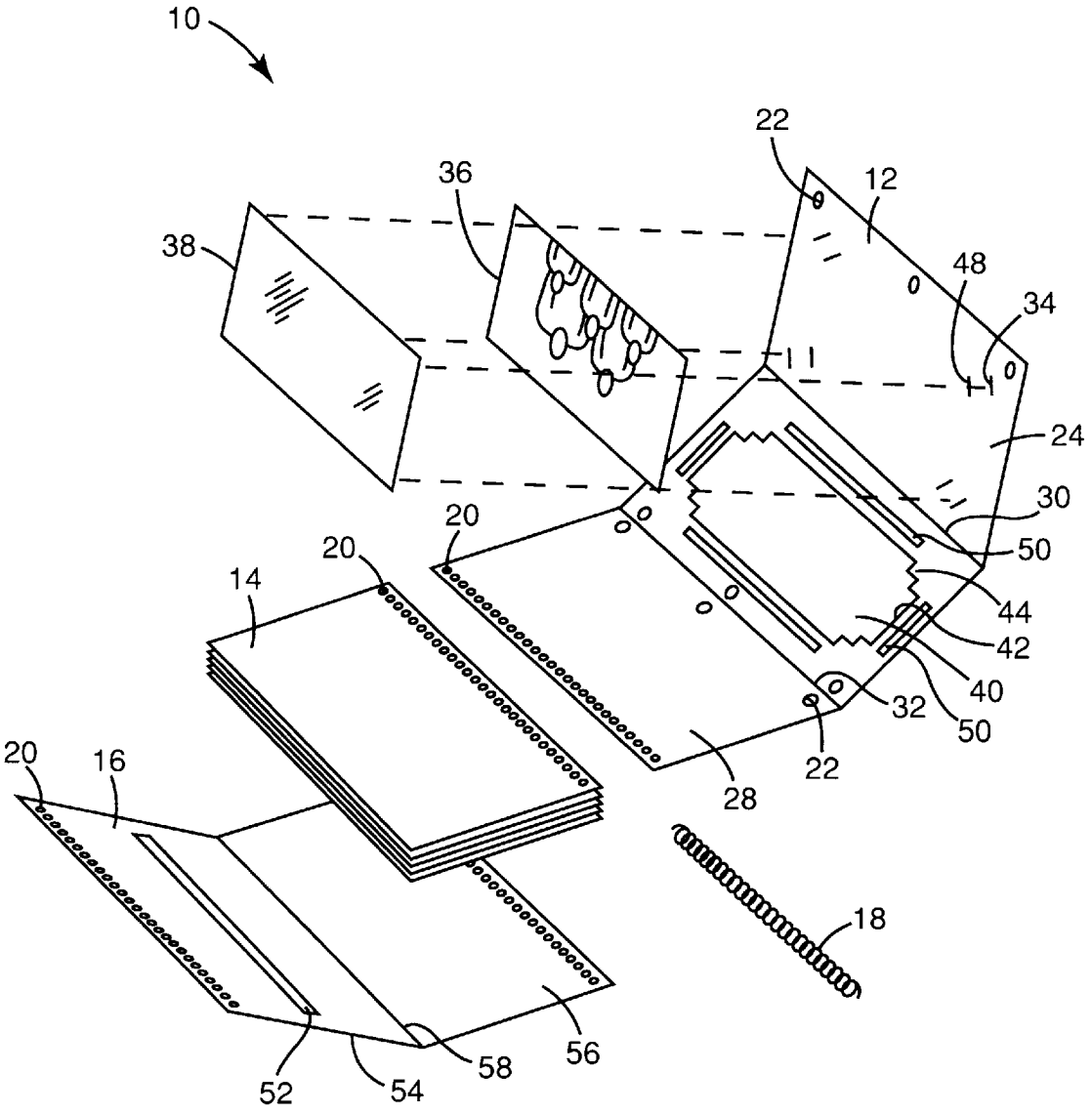
FIG. 2 is an exploded perspective view of the calendar of FIG. 1.

With particular reference to FIG. 2, the picture section 12 includes a backing panel 24, a frame panel 26, and preferably a base panel 28, all of which are preferably made of paperboard (i.e., paper or cardboard material). The backing panel 24, frame panel 26, and base panel 28 are preferably formed of a single piece of paperboard wherein the panels 24, 26, and 28 are defined by the addition of a first folding edge 30 separating the backing panel 24 and the frame panel 26, and a second folding edge 32 separating the frame panel 26 and the base panel 28. However, the panels 24, 26, and 28 could instead be formed separately and then be flexibly joined together, e.g., by a strip of adhesive tape joining their edges, a coil similar to coil 18, or other binding means. The backing panel 24 has slits 34 defined therein for receiving the edges of a purchaser-selected photo 36 so that the photo is maintained within the backing panel 24 in abutting relation. A transparent cover sheet 38 made of mylar, acetate, or other transparent materials, and which is sized to fit with its edges in the slits 34 atop the photo 36, is provided. The frame panel 26 includes a window 40, and the backing panel 24 and frame panel 26 may be folded into abutment with the photo 36 and cover sheet 38 therebetween to display the photo 36 within the window 40 (as shown in FIG. 1). The base panel 28 is foldable about the second folding edge 32 to move the base panel 28 into abutment with the backing panel 24 to better maintain the backing panel 24 against the frame panel 26, and additionally to provide structure to which the pages 14 and pocket section 16 can be attached in the manner illustrated in FIG. 1. Now that the structure and operation of the picture section 12 has been generally described, certain aspects of this structure will now be discussed in greater detail.

Figure 3:
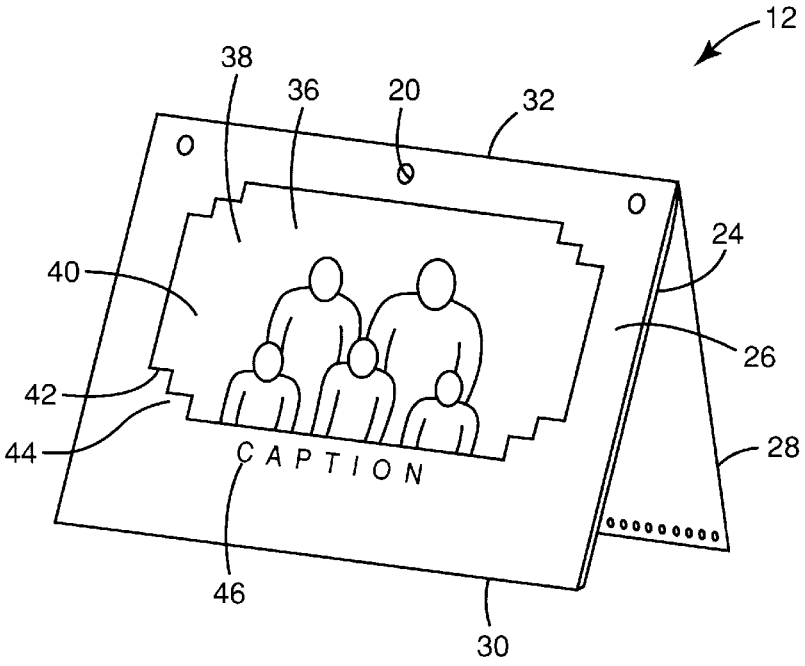
FIG. 3 is a perspective view of the picture section of the calendar of FIGS. 1 and 2.

The window 40 is desirably formed with an aesthetically-styled border 42, an exemplary border style being illustrated in FIGS. 1–3. The particular design of the window 40 illustrated in FIGS. 1–3, wherein the window 40 has a generally rectangular shape with corners 44 that are "rounded" or filled in with diagonal sections is particularly preferred because it allows a window 40 which is sized to encompass substantially all of the photo 36, but wherein the filled-in corners 44 of the window 40 strategically cover the slits 34. This masks the insertion of the edges of the photo 36 within the slits 34 when the frame panel 26 is folded over the backing panel 24. Masking of the slits 34 is desirable because visible slits 34 visibly convey the (true) impression that the backing panel 24 (and more generally the picture section 12) is made of paperboard or other thin material. However, if high quality printing is used to decorate the frame panel 26, the illusion can be created that the assembled picture section 12 shown in FIG. 1 is made of metal or wooden materials. Exposure of the slits 34 can detract from this illusion, and thus it is preferred that the window 40 be configured so that the slits 34 rest outside its borders 42 when the frame panel 26 is folded over the backing panel 24. As FIG. 1 illustrates, a caption 46 can be printed on the frame panel 26 adjacent the window 40. Alternatively, if the frame panel 26 is coated with laminate or plastic material, purchasers may be able to add their own captions 46 or comments by use of dry-erase markers or other erasable writing implements.

Alternate sets of slits 48 may also be included if differently-sized photos 36 are to be accommodated, e.g., 8"×10" rather than 10"×13" photos. Where the alternate slits 48 are disposed inwardly of the borders 42 of the window 40, as is the case in FIG. 2, the window 40 will display the insertion of the edges of the photo 36 within the slits 48 when the frame panel 26 is folded over the backing panel 24. However, as will be discussed at greater length below, it is possible to provide additional cover sheets 38 which are generally opaque but which have a clear area defined therein through which the photo 36 may be viewed, with the opaque area(s) resting over the slits 48 to mask them from view.

The frame panel 26 also preferably includes adhesive means for adhering the backing panel 24 and frame panel 26 together so that the cover sheet 38 and photo 36 are firmly engaged in abutting relation between the base panel 28 and frame panel 26. This is preferably done by placing adhesive strips 50 or adhesive areas having other shapes about the circumference of the window 40 on the backing panel 24 and/or the frame panel 26, but outside of the region bounded by the slits 34. This arrangement has the effect of adhering the backing panel 24 to the frame panel 26, rather than adhering the backing and/or frame panels 24, 26 to the cover sheet 38. This has been found to provide the picture section 12 with an overall more attractive appearance because it will maintain the backing panel 24 and frame panel 26 together as a unit despite any curvature in the backing panel 24 and/or frame panel 26, or any elastic resiliency at the first folding edge 30 which would tend to cause the backing panel 24 and frame panel 26 to separate. If the adhesive strips 50 are provided by two-sided tape, or lines of gum or other adhesive (perhaps covered with peel-off protective strips to allow their preparation for use), it is also preferable that the surfaces of the backing and/or frame panels 24, 26 which engage the adhesive strips 50 be coated with plastic or laminate material which provides repeated peeling away and re-sticking to the adhesive strips 50. Releasable adhesion between the backing panel 24 and frame panel 26 may also be achieved by utilizing strips of hook-and-loop material (e.g., VELCRO material), magnetic material, or material which exhibits surface-to-surface contact adhesivity (e.g., rubberized vinyl) for the adhesive strips 50.

As can be seen particularly in FIG. 1, the base panel 28 is preferably dimensioned slightly longer in the direction perpendicular to the second folding edge 32 so as to allow the base panel 28 to be more easily bound to the pages 14, the pocket section 16, or other material without interference from the frame panel 26 or backing panel 24.

Referring to FIGS. 1 and 2, the pages 14 may be paperboard pages bearing any sort of printed matter, e.g., calendar entries, inspirational quotations, lined areas for filling in by the purchaser, and so on. Coating the pages 14 with plastic or laminate material may allow the purchaser to add erasable comments to the pages 14, e.g. to-do lists and the like. While not shown with specificity in FIGS. 1 and 2, the pages 14 may actually be duplicate picture sections similar to picture section 12, with the pages 14 illustrated in FIGS. 1 and 2 being the rear surfaces of their base panels. In this case, as the pages 14 of the calendar 10 are turned, each printed page 14 is situated adjacent a picture section 12 wherein the purchaser may install photos.

Referring again to FIGS. 1 and 2, the pocket section 16 provides a slot 52 which defines a pocket wherein duplicate photos or other materials (e.g., date or address books) may be stored. Referring particularly to FIG. 2, the pocket section 16 includes two pocket panels 54 and 56 separated by a fold line 58. At least one of the pocket panels 54 and 56 includes at least one slot 52 cut therein. When the pocket panels 54 and 56 are folded into abutment about the fold line 58, the pocket section 16 defines a pocket accessible from the slot 52. By binding the pocket panels 54 and 56 into the calendar 10 at their edges opposite the fold line 58, the pocket panels 54 and 56 are always maintained together in relatively close relation so they will not separate when materials are inserted within the slot 52 and pocket.

While the picture section 12 of FIGS. 1 and 2 is particularly designed to be bound in combination with printed matter, it can be separated from the printed matter and used alone as illustrated in FIG. 3. In this case, the backing panel 24 and frame panel 26 may be supported by the base panel 28, which is folded away from the backing panel 24 to serve as a stand. If a removable binding means is provided, such as the coil 18 illustrated in FIGS. 1 and 2, the purchaser is provided with the option of using the picture sections 12 individually or binding them together with other picture sections 12, pages 14, pocket sections 16, or other printed matter as the purchaser desires (as well as in whatever order the purchaser desires). Thus, it may be desirable to provide the calendars illustrated in FIGS. 1 and 2 in disassembled form as a kit for assembly by the purchaser. The purchaser may then construct a personalized calendar, a photo album, or another compilation. If the collated matter is not bound at the binding holes 20, it may be bound at the hanging holes 22 by use of a three-ring binder or the like.

Figure 4:
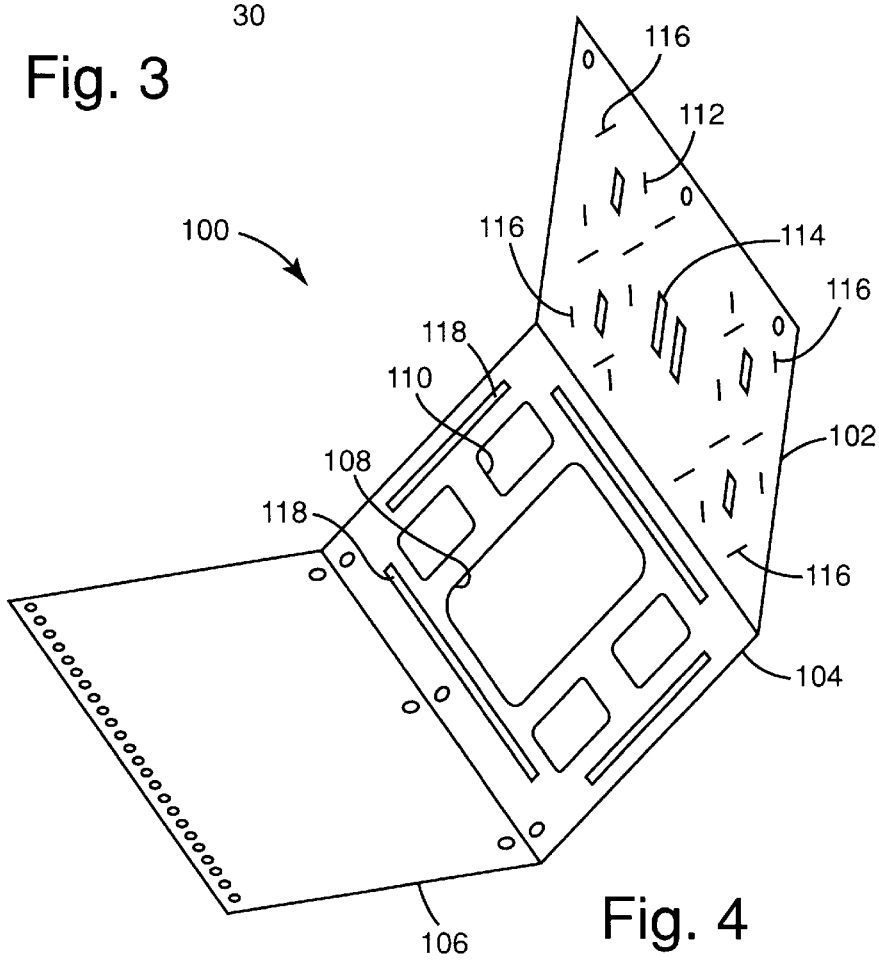
FIG. 4 is a disassembled perspective view of a portion of an alternate picture section suitable for use in the calendars of FIGS. 1 and 2.

FIG. 4 illustrates an alternate picture section 100. The picture section 100 includes a backing panel 102, a frame panel 104, and a base panel 106. Unlike the frame panel 26 of FIGS. 1—3, the frame panel 104 has multiple windows 108 and 110 defined therein. The windows 108 and 110 may be sized to accommodate standardsized photographs (not shown), e.g., window 108 accommodates 5"×7" photos and windows 110 accommodate 3"×5" photos. The edges of photos may be accommodated by the backing panel 102 within slits 112 which are placed to rest adjacent the windows 108 and 110 when the backing panel 102 is folded adjacent the frame panel 104, or by adhesive strips 114 or other adhesive areas which are placed to rest opposite one or more windows 108 and 110. As with the picture section 12 of FIGS. 1—3, slits 116 are also provided for receiving the edges of a transparent cover sheet (not shown), and the slits 116 may simultaneously be used for the insertion of the edges of photos as well. Again, adhesive strips 118 or other adhesive means may be provided on the frame panel 104 and/or backing panel 102 to maintain them together once the photos and cover sheet are installed within the backing panel 102.

Figure 5:
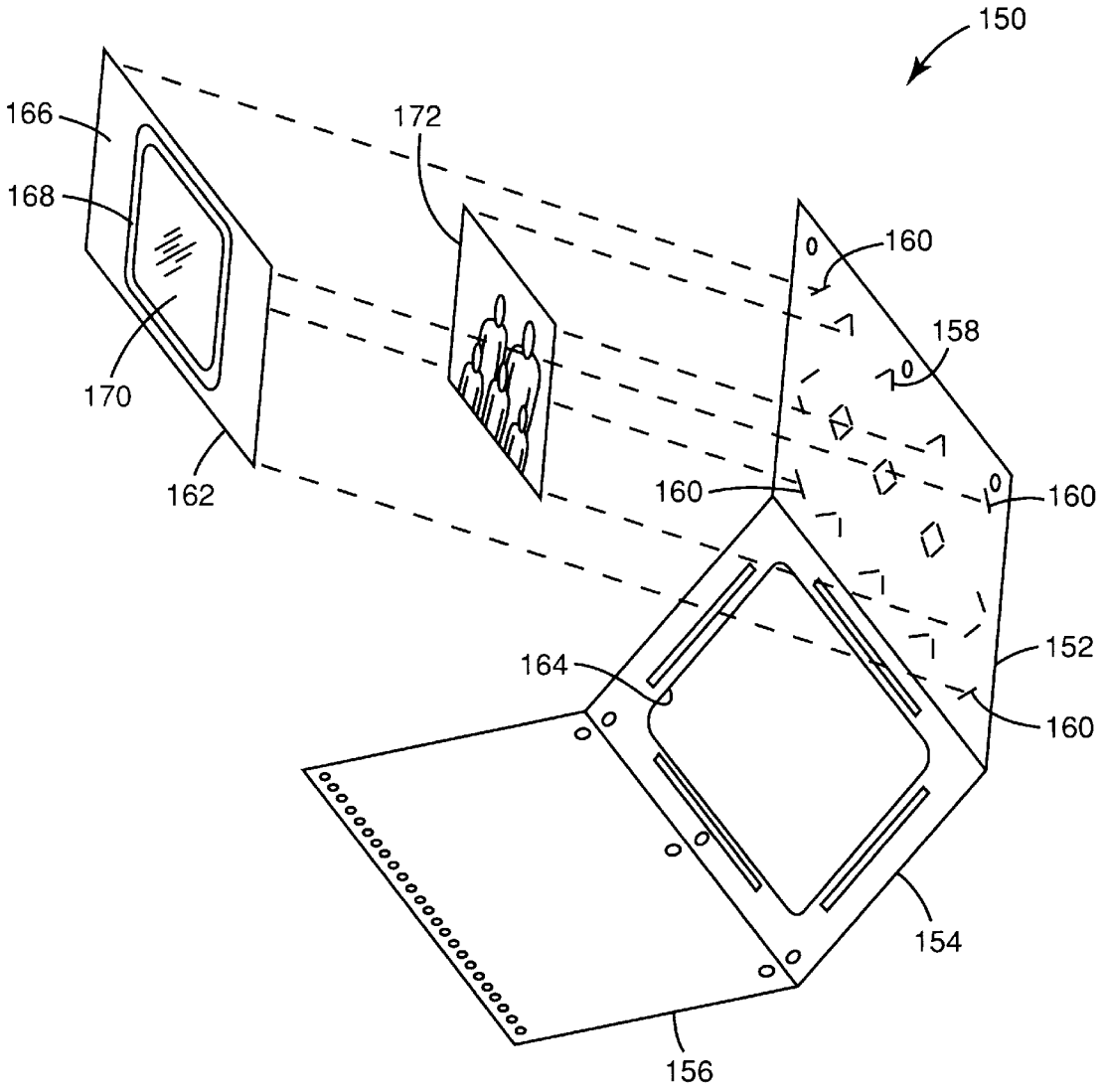
FIG. 5 is an exploded perspective view of another alternate picture section suitable for use in the calendars of FIGS. 1 and 2.

FIG. 5 illustrates another alternate picture section 150. The picture section 150 generally corresponds to the picture section 12 of FIGS. 1–3 and includes a backing panel 152, a frame panel 154, and a base panel 156. The backing panel 152 includes an array of slits 158 distributed about its area for accommodating a wide variety of differently-sized photos at a variety of different locations. The backing panel 152 additionally includes outermost slits 160 for accommodating a cover sheet 162. The frame panel 154 includes a window 164 which generally encompasses the area bounded by the slits 158 and 160. The cover sheet 162 is imprinted with opaque masked areas 166 and/or decorative printed or etched borders 168 bounding clear areas 170 through which a photo 172 may be viewed. In effect, the masked areas 166 and/or borders 168 on the cover sheet 162 serve as the frame around the photo 172. Thus, by providing a picture section 150 with a variety of cover sheets 162 having one or more clear areas 170 having a variety of sizes and orientations, a purchaser can install a wide variety of differently-sized photos at different orientations.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, with reference to FIGS. 1 and 2, other binding means apart from the coil 18 may be utilized, e.g., rings, combs, saddle stitching, and perfect binding. The coil 18 is preferable because it is removable, easily installable, and it may accommodate cords or rods from which the calendar 10 may be hung. The coil 18 may also accommodate pens or other writing implements for convenient use by the purchaser.

Second, the frame panels 26, 104, and 154 (and more generally the picture sections 12, 100, and 150) illustrated above may incorporate other decorative features to enhance their appearance. Referring particularly to the calendar 10 of FIGS. 1 and 2, the frame panel 26 may be made of (or reinforced with) foamboard to provide them with a more solid appearance, and the edges of the window 40 may be beveled to provide a unique look. Alternatively or additionally, a slipcover may be provided wherein the picture section 12 may be inserted, second folding edge 32 first, and an aperture defined in the slipcover can allow display of the photo 36 through window 40. In this case, the borders 42 of the window 40 in the frame panel 26 can serve as a matte for the photo 36. Hanging holes may be situated in the slipcover in positions complementary to the hanging holes 22 in the calendar 10 to allow hanging of the calendar 10 with the installed slipcover. The purchaser can withdraw one picture section 12 from the slipcover and insert another one as desired. Such a slipcover could even be made of metal or thin wood to further enhance the appearance of the picture section 12. As another option, the cover sheets 12 and 162 discussed above could also include embossed or raised areas, e.g., the border 168, which are molded or thermoformed into the cover sheets.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. A picture frame comprising:

a. a backing panel including slits formed therein, b. a frame panel attached to the backing panel at a first folding edge, the frame panel bounding a window defined therein, c. a base panel attached to the frame panel at a second folding edge, d. a generally transparent cover sheet bounded by sheet edges, the cover sheet being sized to fit against the backing panel with portions of its sheet edges within the slits.

e. multiple pages foldably affixed to the backing panel, the pages including a pocket section having two pocket panels separated by a fold line, wherein one pocket panel includes a slot cut therein, the pocket panels being folded into abutment about the fold line to define a pocket accessible from the slot.

2. The picture frame of claim 1 including adhesive means for adhering the backing panel and frame panel together.

3. The picture frame of claim 2 wherein the adhesive means includes at least one adhesive strip.

4. The picture frame of claim 1 wherein the window of the frame panel does not overlap the slits of the backing panel when the frame panel is folded over the backing panel at the first folding edge.

5. The picture frame of claim 1 wherein the frame panel includes at least two windows defined therein.

6. The picture frame of claim 1 wherein the slits are dispersed about the edges of a generally rectangular area on the backing panel.

7. The picture frame of claim 6 wherein slits are also located within the generally rectangular area.

8. The picture frame of claim 6 further comprising adhesive means on the backing panel for adhering the backing panel and frame panel together, the adhesive means being situated outside the generally rectangular area.

9. The picture frame of claim 1 wherein the cover sheet includes opaque areas and transparent areas thereon, the opaque areas surrounding the transparent areas.

10. The picture frame of claim 1 wherein the cover sheet includes embossed areas defined therein.

11. In combination, at least two of the picture frames of claim 1, wherein the backing panels of the picture frames are foldably affixed together.

12. The picture frame of claim 1 wherein the pages are foldably affixed to the backing panel by a spiral coil.

13. The picture frame of claim 1 wherein the pages include at least two pocket sections.

14. A calendar comprising:

a. a picture section including (1) a backing panel including at least two slits formed therein, (2) a frame panel attached to the backing panel at a first folding edge, the frame panel bounding a window defined therein, (3) a base panel attached to the frame panel at a second folding edge, (4) a transparent cover sheet bounded by sheet edges, the cover sheet being sized to fit against the backing panel with portions of its sheet edges within the slits, b. multiple pages foldably affixed to the backing panel, and c. a pocket section having two pocket panels separated by a fold line, wherein one pocket panel includes a slot cut therein, the pocket panels being folded into abutment about the fold line to define a pocket accessible from the slot.

15. The calendar of claim 14 wherein the frame panel includes at least two windows defined therein.

16. The calendar of claim 14 including at least two picture sections.

17. The calendar of claim 14 including at least two pocket sections.

18. The picture frame of claim 14 wherein the cover sheet includes opaque areas and transparent areas thereon, the opaque areas surrounding the transparent areas.

19. A picture frame comprising:

a. a backing panel including slits formed therein, b. a frame panel attached to the backing panel at a first folding edge, the frame panel bounding a window defined therein, c. a base panel attached to the frame panel at a second folding edge, d. a generally transparent cover sheet bounded by sheet edges, the cover sheet being sized to fit against the backing panel with portions of its sheet edges within the slits, e. a pocket section foldably affixed to the backing panel, the pocket section having two pocket panels separated by a fold line, wherein one pocket panel includes a slot cut therein, the pocket panels being folded into abutment about the fold line to define a pocket accessible from the slot.

* * * * *